United States Patent [19]

Beard

[11] 4,418,847

[45] Dec. 6, 1983

[54] TIP SEALING TILT VALVE STRUCTURE FOR VISCOUS FLOW LIQUIDS

[76] Inventor: Walter C. Beard, South St., Middlebury, Conn. 06762

[21] Appl. No.: 394,517

[22] Filed: Jul. 2, 1982

[51] Int. Cl.[3] ..... B65D 83/14

[52] U.S. Cl. ..... 222/402.23; 222/545

[58] Field of Search ..... 222/402.21, 402.22, 222/402.23, 545

[56] References Cited

U.S. PATENT DOCUMENTS

| | | | |
|---|---|---|---|
| 2,709,111 | 5/1955 | Green . | |
| 2,731,298 | 1/1956 | Green . | |
| 2,945,494 | 7/1960 | Bowen | 222/402.22 X |
| 3,060,965 | 10/1962 | Taggart . | |
| 3,357,604 | 12/1967 | Barker | 222/402.23 |
| 3,450,316 | 6/1969 | Barker . | |
| 3,454,198 | 7/1969 | Flynn | 222/402.22 X |
| 3,506,165 | 4/1970 | Beard | 222/402.22 |
| 3,547,405 | 12/1970 | Ewald | 222/402.22 X |
| 3,584,789 | 6/1971 | Traynor . | |
| 3,635,379 | 1/1972 | Angele | 222/402.22 |
| 3,759,427 | 9/1973 | Stanley et al. | 222/402.23 |
| 3,777,947 | 12/1973 | Klema | 222/402.23 |
| 3,901,410 | 8/1975 | Schultz | 222/402.22 X |
| 3,920,165 | 11/1975 | Schultz | 222/402.23 |
| 4,008,834 | 2/1977 | Towns | 222/402.23 |

OTHER PUBLICATIONS

Apr. 1972 Reprint "Aerosol Age" Publication Entitled "The Beard Universal Seal—Tip Valve", pp. 17–19 incl.

*Primary Examiner*—David A. Scherbel

*Attorney, Agent, or Firm*—Hill, Van Santen, Steadman & Simpson

[57] ABSTRACT

An aerosol valve for pressurized containers having a tip seal to seal the dispensing nozzle at its extreme outer end portion and having a base seal in which each seal is operated simultaneously by tiltable deflection of the nozzle to dispense the contents of the aerosol container. Another embodiment of the invention sequentially opens the tip seal followed by opening of the base seal.

9 Claims, 13 Drawing Figures

TIP SEALING TILT VALVE STRUCTURE FOR VISCOUS FLOW LIQUIDS

BACKGROUND OF THE INVENTION

1. Field of the Invention

This invention lies in the field of aerosol valves and to aerosol containers fitted with such valves, and, more specifically, the invention relates to aerosol valves of the type adapted particularly, but not exclusively, for the dispensing of viscous liquids.

2. Description of the Prior Art

In the aerosol field, valve structures for aerosol type dispensing devices have heretofore been known wherein the valve is opened by deflecting the outer end portion of a nozzle stem member from a vertical position in relation to the center axis of the valve body, the deflection being accomplished conveniently by the finger pressure of a human operator. The deflection upsets or breaks a main seal existing between the nozzle dispensing orifice and an internal core member.

In prior art tiltable valve assemblies, a problem has existed in preventing leakage of aerosol container contents past the valve orifice. Constructional arrangements to overcome this type of deficiency are believed to have been long desired in the aerosol valve art, particularly as regards a valve structure adapted for the dispensing of viscous liquids. Because of this type of leakage in prior art tip sealing valve assemblies, the primary advantage of tip sealing valve structures is not available to the art. This advantage lies in the capacity of a tip sealing valve assembly to seal the nozzle at its extreme outer end portion, thereby preventing exposure of aerosol container contents to the oxidizing influence, or to the degradating influence of atmospheric exposure.

An advance in the state of the art of tip sealing, tiltable valve assemblies is needed in order to permit more extensive utilization of tip sealing, tiltable valve structures.

SUMMARY OF THE INVENTION

More particularly, the present invention provides an improved tiltable valve assembly which includes not only tip sealing capability, but also a base sealing capability with the valve opening capabilities at tip and base being operated simultaneously or in sequence through the deflection of the nozzle or stem portion of the valve assembly by the finger pressure of a human operator or the like.

In one aspect, the present invention provides an improved tip sealing, tiltable valve assembly adapted to minimize leakage of an aerosol container's contents past the tip region of the valve assembly.

In another aspect, the present invention provides a tiltable valve assembly with both tip sealing and base sealing capability, both the tip sealing and the base sealing functions being operable through the deflection of the nozzle stem member by a human operator.

Another object of the present invention is to provide a valve structure of the class generally indicated above wherein resealing of the valve, and a normally closed configuration at each of the tip region and base region thereof, is accomplished by mere finger pressure release after a valve opening has been accomplished.

Other and further objects, aims, purposes, features, advantages, embodiments, and the like will be apparent to those skilled in the art from the present specification taken with the accompanying drawings.

DETAILED DESCRIPTION

Figure 1:
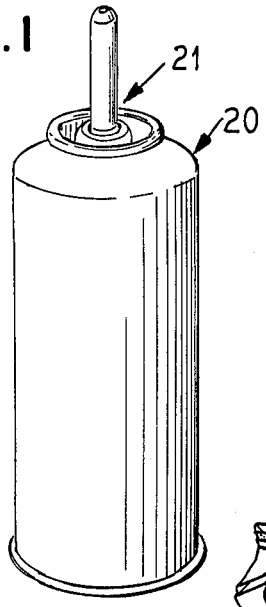
FIG. 1 is a perspective view of one embodiment of an aerosol container fitted with one embodiment of a tip sealing tiltable valve structure of the present invention.

An aerosol container 20 is fitted with a tip sealing tilt valve structure 21 of the present invention. Container 20 is provided with an axially located aperture 22 having a rolled perimeter, container 20 being formed in this instance of sheet metal.

A roll 23 makes nesting engagement with the perimeter of a metallic mounting cup 24. Interior surfaces of such perimeter are provided with a coating of a sealing material of resilient elastomeric plastic material 26 so that, when the mounting cup 22 is fitted over the roll 23 and formed by collet fingers to produce a retaining crimp 22*a*, the preformed valve assembly 21 is sealingly associated with the container 20.

Figure 2:
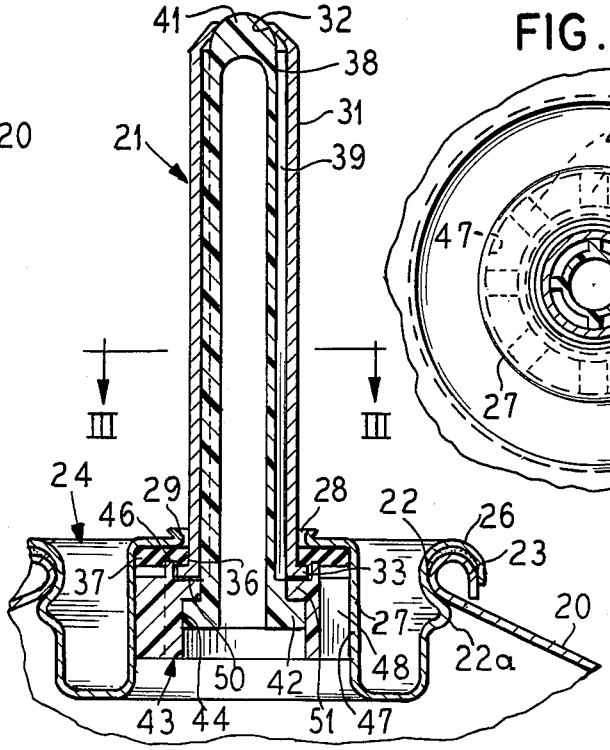
FIG. 2 is a fragmentary enlarged vertical sectional view along the axis of the valve structure shown in FIG. 1.
Figure 3:
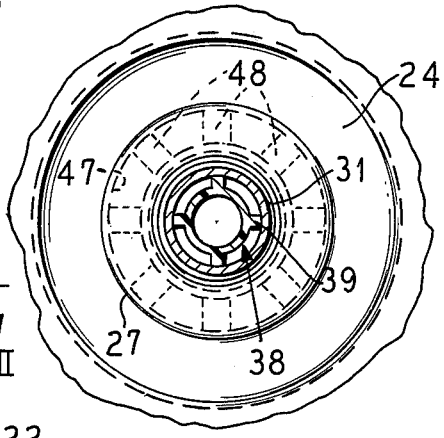
FIG. 3 is a view taken along the line III—III of FIG. 2.

As those skilled in the art will appreciate, the internal diameter of the aperture 22 is typically standardized in the aerosol valve trade while the mounting cup 24 is so formed as to have an inner wall member 27 defined therein which can have a diameter particularly chosen for an individual type of valve structure desired. Axially, through the center portion of the mounting cup 24, an aperture of 28 is defined which may be provided, as in assembly 21, with an upstanding lip 29 which serves as a stiffening and reinforcing means. Through the aperture 28 is extended a nozzle stem member 31 which, at its outer end portion, is provided with a dispensing orifice 32. At the opposite end of nozzle stem member 31 a radially outwardly extending flange 33 is provided. The nozzle stem member 31 extends through the central aperture 36 of a resilient elastomeric gasket 37 which makes abutting contact with adjacent outer wall portions of the nozzle stem member 31 and flange 33 relative to the gasket 37. The nozzle stem member 31 has a normally closed configuration as is illustrated in FIG. 2.

Longitudinally extending through the nozzle stem member 31 is a flexible valve stem or core 38 which is provided along its outer wall portions with longitudinally outwardly extending guide ribs 39 which are in circumferentially equally spaced relationship to one another. Preferably at least three such guidance ribs for any given core 38 are employed although four is a presently more preferred number of such ribs. These ribs 39 make sliding engagement with the inside walls of the nozzle stem member 31 while the upper or outer end portion of the core 38 is provided with a generally spherically rounded dome 41 which contacts the inner lip portions of dispensing orifice 32 to effectuate a tip seal between the nozzle stem member 31 and the core 38. The base portion of the core 38 is provided with a radially outwardly extending flange 42 while interior portions of the core 38 are hollow. As those skilled in the art will appreciate, any convenient structure or construction material can be employed for the core 38, but, in general, the core 38 is comprised of a flexible plastic which is adapted for the specific end use requirements intended for a given tilt valve structure 21.

The base of the core 38 including the flange 42 makes seating engagement with a moveable cup member 43 which mates therewith in a region of a central aperture 44 defined in the cup member 43. If desired, the cup member 43 and the core 38 can be integral and formed of the same material. In the tilt valve structure 21, however, a different material of construction is employed for the core 38 from that which is employed for the cup member 43, with the cup member 43 here being formed of a more rigid material than is employed for the core member 38, although the cup member 43 is formed of a plastic preferably. An upstanding annularly extending rib member 46 is provided for the cup member 43 and is integrally formed therewith. This rib member 46 seats against the lower face of the gasket 37 which gasket is formed of an elastomeric material which is deflected by the rib member 46 when the valve structure 21 is in the closed configuration illustrated in FIG. 2. The desired seating engagement between rib member 46 and gasket 37 can be achieved by an convenient means which applies axially extending yielding biasing force against the cup member 43. In the embodiment shown in FIG. 2, for example, this yielding biasing pressure is provided by the pressurized fill in the aerosol container 20. In the embodiment shown, the outer circumferentially extending side wall portions 47 of the cup member 43 are provided with a plurality of radially outwardly extending ribs 48. The radially outward edge portions of the ribs 48 slidably engage adjacent portions of the inner wall member 27 of mounting cup 24. If desired, ribs 48 can frictionally engage such adjacent portions.

Substantial open space exists in the region between adjacent, circumferentially spaced ribs 48 and between the side walls 47 and the inner wall 27 so as to provide a maximum of space through which the fill of an aerosol container 20 can pass when the fill is being discharged from the aerosol container 20 while the tilt valve structure 21 is open.

Figure 4:
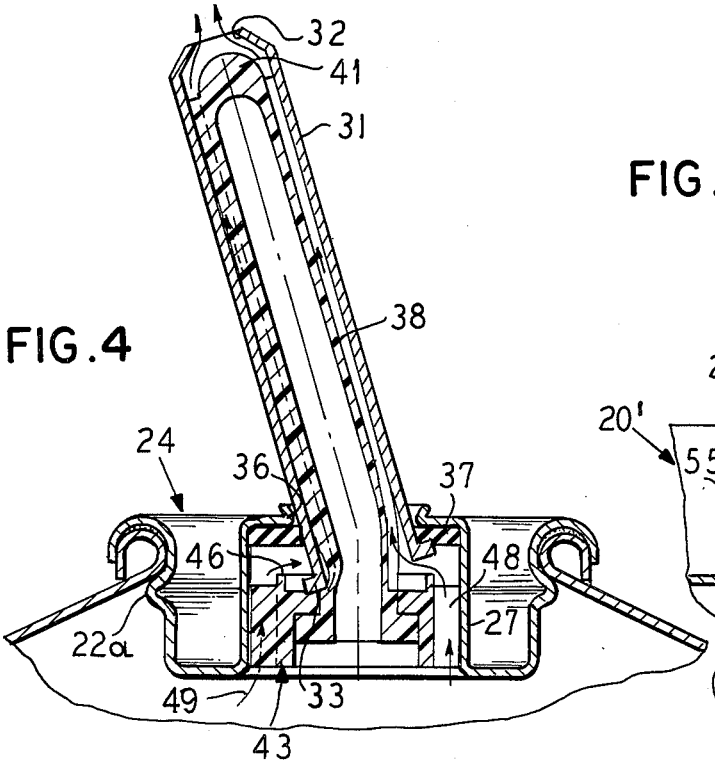
FIG. 4 is a view similar to FIG. 2, but showing the valve assembly in a tilted configuration, such as the valve would assume in a normal valve-opening configuration.

The open configuration of tilt valve structure 21 is illustrated generally by FIG. 4. Here the nozzle stem member 31 has been deflected, as by a human finger (not detailed) or the like, from its upright position depicted, for example, in FIG. 2. As the nozzle stem member 31 is deflected, a camming action is provided by the radially extending flange 33 which flange 33 exerts a downward force against contacting surfaces of the moveable cup member 43, thereby causing the moveable cup member 43 to slidably move away from the gasket 37, the sliding movement of the cup member 43 being guided by adjacent surface portion of the inner wall member 27. As the moveable cup member moves thus downwardly, the core 38 is also moved downwardly, and the core member 38 thus slidably moves relative to the nozzle stem member 31 with the result that the dome 41 is moved away from sealing engagement with orifice 32, thereby resulting in an opening of the valve assembly 21 which permits material to flow from the interior of the container 20 in the pathway illustrated by the arrows 49 in FIG. 4. During this dispensing operation, the core 38 experiences side wall deflection in the region of the flange 33 which in effect enhances the downward travel of the core 38 relative to the stem member 31. In addition, since the core 38 has some resiliency, it operates to provide a yielding bias which tends to cause the nozzle stem member 31 to return to its upright configuration illustrated in FIG. 2 upon the release of deflecting force thereagainst. It is desirable, of course, to have the core return completely to its original configuration after the valve structure 21 is closed so as to permit repeated opening and closing operations for a given valve structure 21.

When the valve structure 21 is in its closed configuration as shown in FIG. 2, a positive sealing action is achieved between the annular rib member 46 and gasket 37. Simultaneously a sealing is also afforded between the dome 41 and the orifice 32. To assure achievement of this sealing action at both locations, a space or slight clearance 50 is provided between the flange 33 and the radially inwardly extending flange portion 51 of the cup member 43. As those skilled in the art will appreciate, because of the high stress force exerted between the annularly extending rib member 46 and the gasket 37, a primary sealing engagement between these elements is in effect when the valve structure 21 is in its closed configuration.

As observed above, in effect, the gasket 37 carries the nozzle stem member 31. Some sealing action is achieved between the gasket 37 and the nozzle stem member 31 even as the nozzle stem member 31 is in its open or deflected and tilted configuration as shown in FIG. 4, thereby minimizing and even eliminating loss of gaseous pressure from the interior of the container 20 when the stem member 31 is tilted from an upright position.

Figure 5:
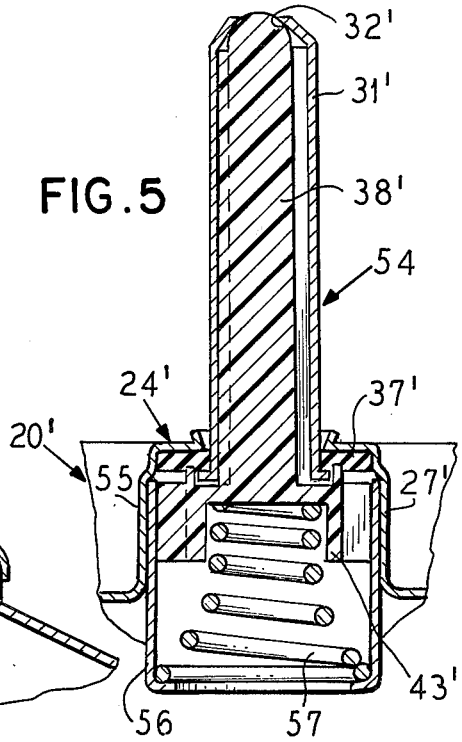
FIG. 5 is a view similar to FIG. 2, but showing an alternative embodiment of a tip sealing tilt valve structure of the present invention.

Referring to FIG. 5, there is seen an embodiment similar to that of FIGS. 1 through 4, the valve structure here shown being designated in its entirety by the numeral 54. Parts of the valve structure 54 which are similar to those of the valve structure 21 are similarly numbered but with the addition of prime marks thereto. In the valve structure 54, the moveable cup 43' and the core 38' are integrally formed of a common plastic resilient material. Also, the central portion of the core 38' is solid. The plastic material selected for any given valve structure 54 is selected so as to be compatible with the fill to be housed in the container 20' fitted with the valve structure 54. The mounting cup 24' is here modified so as to contain an offset 55 in its inner wall member 27'. The offset 55 serves to receive a spring retainer cup 56 which through a frictional association makes clamping engagement with the inner wall surfaces of inner wall member 27'. A generally conically tapered compression spring 57 seats in the cup 56 and exerts a yielding bias against the undersurface of the moveable cup 43'. Thus, the spring 57 helps to maintain the valve structure 21 in a sealed and closed configuration when the structure is in its normally upright and closed configuration as illustrated in FIG. 5. Depending upon the nature of the fill for the container 20', the spring 57 can aid in making the valve more responsive and positive in its opening and closing movements, as those skilled in the art will appreciate.

Figure 6:
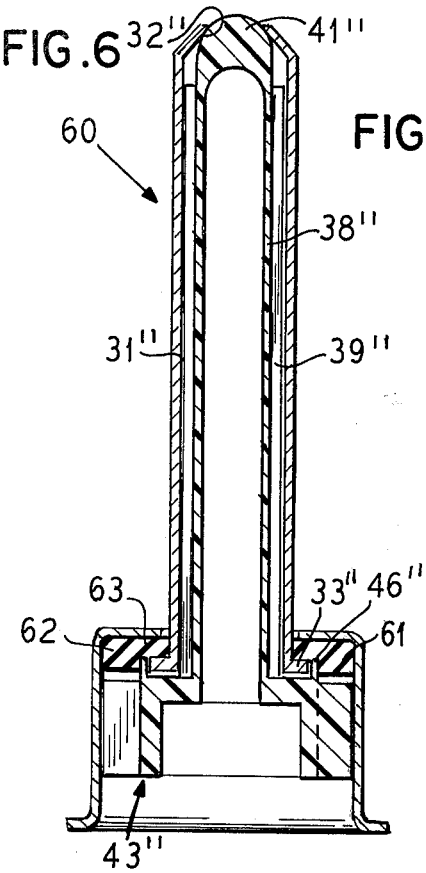
FIG. 6 is a view similar to FIG. 2, but showing yet another embodiment of the present invention which embodiment provides a sequenced opening of the valve assembly wherein first the tip seal is opened after which, as deflection of the nozzle stem continues, an opening of the base region occurs.
Figure 7:
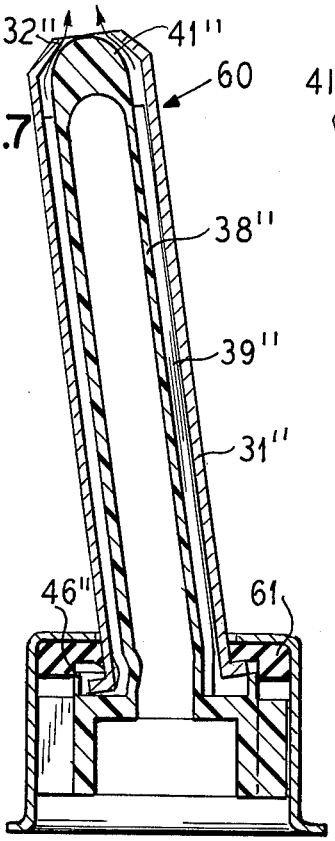
FIG. 7 illustrates the valve of FIG. 6 with the tip region thereof in an open configuration.
Figure 8:
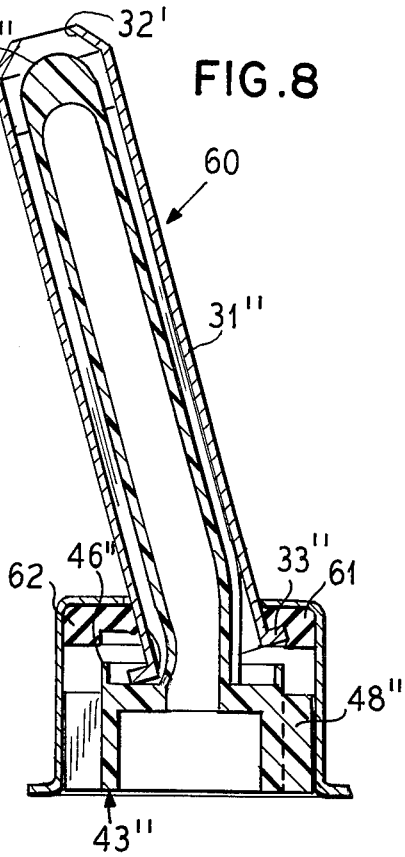
FIG. 8 is a view similar to FIG. 7, but showing the valve structure of FIG. 6 with both the tip seal open and the base seal open.

Referring to FIGS. 6–8, there is as seen another valve structure of the present invention herein designated in its entirety by the numeral 60. The valve structure 60 is of the two-stage opening variety which feature of the present invention is desirable in order to achieve a controlled release of fill from the interior of an aerosol container which can be desirable particularly when significant fill pressures are employed. The elements of the valve structure 60 are generally similar to those of the valve structure 21, except as otherwise herein described, and so, for convenience, similar parts are identically numbered but with the addition of double prime marks thereto. In place of the gasket 37 there is employed a gasket 61 in the valve structure 60. The outer or perimeter portions 62 of the gasket 61 are thickened relative to the inner portions 63 thereof so that an offset or spaced relation exists between the radially outer edge portions of the flange 33'' and radially adjacent portions of the perimeter portion or region 62 of gasket 61. Through this spacing upwardly projects an annularly extending rib member 46'' of the cup member 43''. Thus, there is a seal effectuated between gasket 61 and annular rib member 46'', and also a seal effectuated between the dome 41'' and the orifice 32''.

When the nozzle stem member 31'' is deflected in a valve opening operation, initially the flexible valve core 38'' moves relative to the stem member 31'', thereby opening the orifice 32'' as the dome 41'' moves. At this point, the open space between the core 38'' and the stem member 31'' is essentially at atmospheric pressure. At this time, however, there is still a sealing engagement between the annular rib member 46'' and the gasket 61, all as illustrated generally in FIG. 7. This sealing engagement is effected between side wall portions of the annular rib member 46 and contacting surfaces of the perimeter portion 62.

Continued further deflection of the nozzle stem member 31'' then finally results in the generation of an opening between perimeter portion 62 and annularly extending rib member 46'' at which time fill of a container can pass upwardly between the stem member 31'' and the core 38'' to exit through the orifice 32''. The continued further deflection movement also increases the size of the aperture formed between the dome 41'' and the orifice 32''. The camming action effectuated between the flange 33'' and contacting surface portions of the cup member 43'' is as above described in relation to the valve structure 21.

Obviously, biasing means, such as a spring or the like, can be used to augment closing and opening actions associated with the valve structure 60, as those skilled in the art will appreciate.

Figure 9:
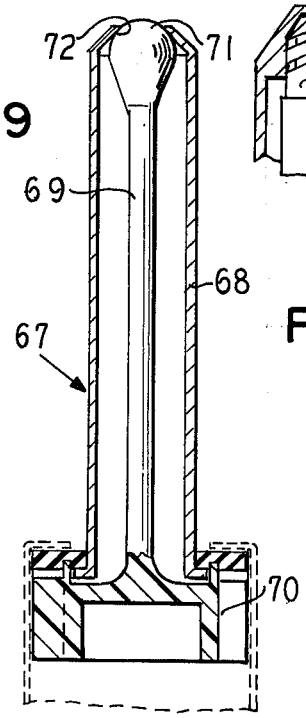
FIG. 9 is a vertical, sectional view through another embodiment of a tip sealing tilt valve assembly of the present invention, this valve structure incorporating a different tip sealing configuration.

Referring to FIG. 9, there is seen a further but fragmentary embodiment of a valve structure of the present invention, this further embodiment being here illustrated by a subassembly and such is designated in its entirety by the numeral 67. Subassembly 67 is seen to comprise a nozzle stem member 68 which has longitudinally and axially extending therethrough a flexible core or valve stem 69 that is formed integrally with a moveable cup member 70. The stem 69 is provided with a bulbous tip 71 adapted to sealingly engage the tip region of the orifice 72 of the stem 68. This arrangement permits a maximum passageway to be defined between the core 69 and the stem 68.

Figure 10:
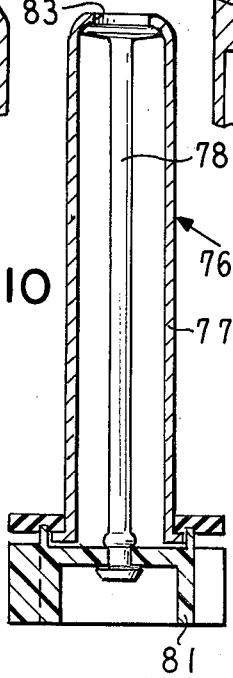
FIG. 10 is a view similar to FIG. 9, but showing another further embodiment of a valve structure of the present invention.

Referring to FIG. 10, there is seen yet another subassembly embodiment for a valve structure of the present invention, such subassembly being designated in its entirety by the numeral 76. Here a nozzle stem 77 is provided with a central and axially extending flexible core or valve stem 79. In this subassembly 76, the moveable cup 81 is formed of a different plastic material from the stem 78. The tip of the stem 78 is provided with a flattened head which makes a sealing engagement across inner lip portions of the orifice 83 defined in the end region of the stem 77, thereby to provide an alternative sealing arrangement for the tip region of a valve structure of the present invention. By having radially outward portions of the tip of the valve stem 78 upwardly turn some yielding biasing action can be achieved between the nozzle stem 77 and the valve stem 78 to enhance a tip seal.

Figure 11:
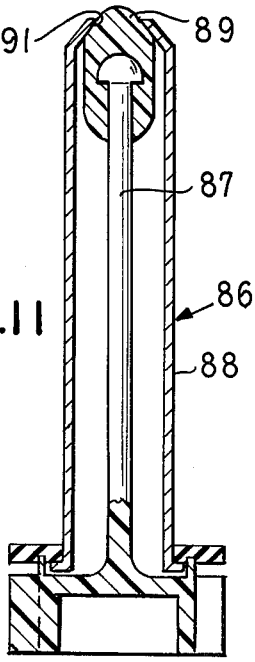
FIG. 11 is a view similar to FIG. 9, but showing another embodiment of a valve structure of the present invention.

Referring to FIG. 11, there is seen another subassembly for a valve structure of the present invention such subassembly being designated in its entirety by the numeral 86. Here, a flexible valve stem or core 87 which longitudinally extends within a nozzle assembly 88 is provided with a resilient but separately formed dome structure 89. Such structure 89 is provided with a socket which is adapted to be received over the end of the stem 87, and which is also adapted to make a sealing engagement across the orifice portion 91 of the nozzle assembly 88, thereby to enhance tip sealing action.

Figure 12:
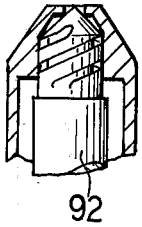
FIG. 12 illustrates in fragmentary form the tip region of a valve structure of the present invention which structure is provided with the capability for achieving swirling action in dispensing an aerosol container's contents.
Figure 13:
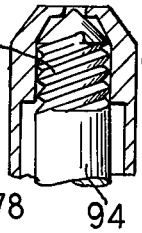
FIG. 13 is a view similar to FIG. 12, but showing a further alternative arrangement for achieving the desired swirling action.

Arrangements to produce for, and to impart a swirling action to, a fill being dispensed from a valve structure of the present invention are provided by the valve tip arrangements illustrated, respectively, in FIGS. 12 and 13. Thus, in the FIG. 12 embodiment, the forward end portion of a core 92 is provided with a helically extending groove set which allows the fill being discharged to follow a spiral pathway in its passage to the atmosphere. Similarly, in the embodiment shown in FIG. 13, the tip of the core 94 is provided with a thread-like configuration 95 which is adapted, in combination with adjacent wall portions of the stem 96 to provide a swirling action for a fill being discharged. The configurations shown in FIGS. 12 and 13 may be used in combination with other embodiments of the present invention as, for example, are herein above described.

Although the teachings of my invention have herein been discussed with reference to specific theories and embodiments, it is to be understood that these are by way of illustration only and that others may wish to utilize my invention in different designs or applications.

I claim:

1. A fluid dispensing valve structure for dispensing the contents of a pressurized container comprising:

a mounting cup member secured to said pressurized container and having communications with the pressurized contents of said container, a resilient seal member carried in said mounting cup member, an elongated tubular nozzle means having a dispensing orifice in one end thereof and having a second end supported in said mounting cup member by said resilient seal member in a generally straight upright extended position, a moveable valve cup member axially slidably carried within said mounting cup member and normally being biased against said resilient seal member to form a first seal means for the contents of said container, said moveable cup member includes a flexible valve stem member extending through said tubular nozzle means and having a tip portion being normally biased in a sealing orientation relative to said dispensing orifice to form a second tip seal means for the contents of said container, and means to open both said first and said second seal means to dispense the contents of said pressurized container when said elongated tubular nozzle means is tiltably displaced relative to its generally straight upright extended position, thereby concurrently flexing said flexible valve stem member.

2. A fluid dispensing valve structure according to claim 1, wherein said elongated tubular nozzle means includes a camming means at said second end thereof to urge said moveable valve cup member away from said resilient seal member when said elongated tubular nozzle means is tiltably displaced from its generally straight upright extended position to dispense the contents of said pressurized container.

3. A fluid dispensing valve structure according to claim 1, wherein said flexible valve stem member comprises a hollow body portion and a spherical domed tip portion arranged to seat in a sealing engagement with a complementary seat portion of said elongated tubular nozzle means, said seat portion defining a seal area surrounding said dispensing orifice.

4. A fluid dispensing valve structure according to claim 1, wherein said flexible valve stem member and said moveable cup member are discrete elements which are interconnected.

5. A fluid dispensing valve structure according to claim 1, wherein said flexible valve stem member and said moveable cup member are formed integral.

6. A fluid dispensing valve structure according to claim 1, wherein said flexible valve stem member includes an enlarged tip sealing head being biased for sealing engagement with a complementary seat portion of said tubular nozzle means, said seat portion defining a seal area surrounding said dispensing orifice.

7. A fluid dispensing valve structure according to claim 1, wherein said means to open said first and second seal means is arranged to open said first seal means subsequent to opening said second seal means.

8. A fluid dispensing valve structure according to claim 1, wherein said flexible valve stem member includes a tip sealing head having a swirl inducing configuration whereby fluid is dispensed from said pressurized container in a swirling pattern.

9. A fluid dispensing valve structure for dispensing the contents of a pressurized container comprising:

a mounting cup member secured to said pressurized container and having communication with the pressurized contents of said container, a resilient seal member carried in said mounting cup member and having a stepped portion defining a first and second sealing face, an elongated tubular nozzle means having a dispensing orifice in one end thereof and having a second end supported in said mounting cup member by said resilient seal member in a generally straight upright extended position, a moveable valve cup member axially slidably carried within said mounting cup member and having an annular ribbed projection with a top rim and side walls, said top rim being normally biased against said first sealing face of said resilient seal member and said side walls having slidable sealing engagement with said second sealing face of said resilient seal member to form a lower seal means for the contents of said container, said moveable cup member includes a flexible valve stem member extending through said tubular nozzle means and having a tip portion, being normally biased in a sealing orientation relative to said dispensing orifice to form a tip seal means for the contents of said container, and means to open said tip seal means and said lower seal means to dispense the contents of said container wherein initial tilt displacement of said tubular nozzle means is effective to concurrently flex said flexible valve stem member and to open said tip seal means and disengage said top rim of said ribbed projection with said first sealing face of said resilient seal member and with further tilt displacement of said tubular nozzle means being effective to disengage said side walls of said annular ribbed projection with said second sealing face of said resilient seal member to open said lower seal means and dispense the contents of said pressurized container.

* * * * *